US008217285B2

(12) United States Patent
Chang

(10) Patent No.: US 8,217,285 B2
(45) Date of Patent: Jul. 10, 2012

(54) LUMINOUS KEYBOARD ASSEMBLY

(75) Inventor: Jen-Tsorng Chang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 848 days.

(21) Appl. No.: 12/345,882

(22) Filed: Dec. 30, 2008

(65) Prior Publication Data

US 2009/0303087 A1 Dec. 10, 2009

(30) Foreign Application Priority Data

Jun. 4, 2008 (CN) ..... 2008 1 0302019

(51) Int. Cl.
*H01H 9/00* (2006.01)

(52) U.S. Cl. ..... 200/313; 200/314; 400/491.2; 400/491.3

(58) Field of Classification Search ..... 200/313, 200/314; 400/491.2, 491.3
See application file for complete search history.

(56) References Cited

U.S. PATENT DOCUMENTS 5,034,602 A * 7/1991 Garcia et al. ..... 250/227.22
5,304,764 A * 4/1994 Kobayashi ..... 200/314
2005/0167254 A1* 8/2005 Oosawa ..... 200/314

* cited by examiner

*Primary Examiner* — Timothy Edwards, Jr.
(74) *Attorney, Agent, or Firm* — Altis Law Group, Inc.

(57) ABSTRACT

An exemplary keyboard assembly includes a light source for emitting light, a light guide plate and a plurality of keys mounted on the light guide plate. The light guide plate includes a light incident surface facing the light source and a light emitting surface. Each key includes a cap, a light guide portion coupled to the cap, and a spring member configured for biasing the light guide portion in a direction away from the light emitting surface of the light guide plate. Each key is movable relative to the light guide plate, in response to manual manipulation thereto, between a depressed position where the light guide portion is attached to and optically coupled to the light emitting surface of the light guide plate thereby illuminating the cap, and a rest position where the light guide portion is spaced apart from the light emitting surface of the light guide plate.

10 Claims, 9 Drawing Sheets

LUMINOUS KEYBOARD ASSEMBLY

BACKGROUND

1. Technical Field

The present invention relates to a keyboard assembly, and particularly to an luminous keyboard assembly.

2. Discussion of Related Art

With the rapid development of electronic technologies, electronic devices, such as computer, mobile telephones and personal digital assistants (PDAs), are now in widespread use. These electronic devices enable consumers to enjoy high technology services almost anytime and anywhere. A keyboard assembly as an input terminal has been an important member of an electronic device.

A typical keyboard assembly does not have the function to illuminate itself, which makes it inconvenient to operate under dark conditions. At present, there are luminous keyboard assemblies which can illuminate themselves. A first kind of luminous keyboard assembly includes a keyboard module with a plurality of keys and a backlight module under the keyboard module. When the backlight module is turned on, the keyboard module illuminates all the keys. A second kind of luminous keyboard assembly includes a keyboard module with a plurality of keys and a plurality of light sources. Each light source illuminates each key independently. When a given key is pressed, a corresponding light source is turned on and then illuminates the given key. The first kind keyboard assembly can not selectively illuminate a single key. However, the second kind of keyboard assembly requires a large amount of light sources to light each key, so the cost will be expensive.

Therefore, a new luminous keyboard assembly is desired to overcome the shortcomings described above.

BRIEF DESCRIPTION OF THE DRAWINGS

Many aspects of the present luminous keyboard assembly can be better understood with reference to the following drawings. The components in the drawings are not necessarily to scale, the emphasis instead being placed upon clearly illustrating the principles of the present luminous keyboard assembly. Moreover, in the drawings, like reference numerals designate corresponding parts throughout the several views.

DETAILED DESCRIPTION OF EMBODIMENTS

Reference will now be made to the drawings to describe in detail of the exemplary embodiments of the luminous keyboard assembly.

Figure 1:
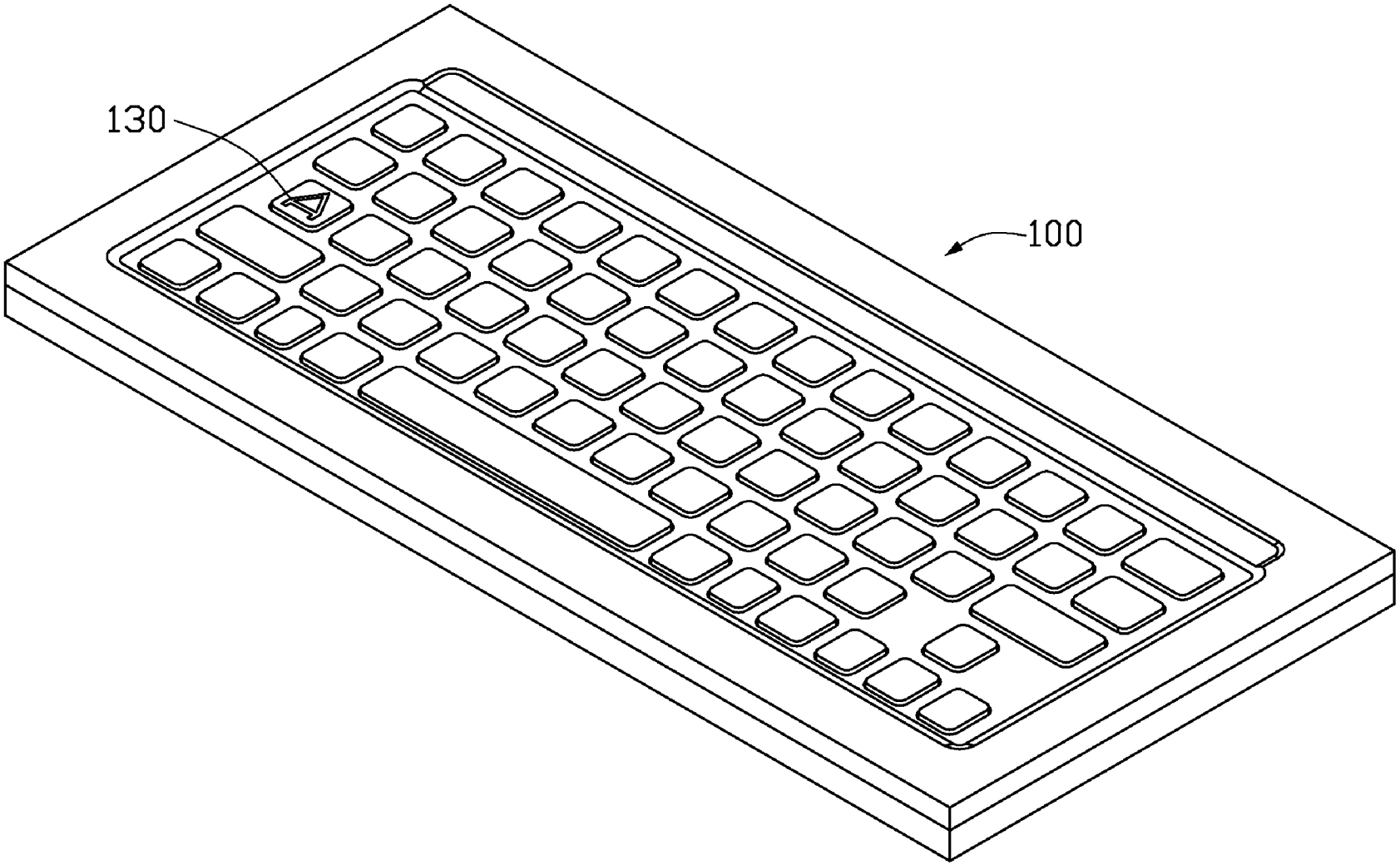
FIG. 1 is a schematic, isometric view of a luminous keyboard assembly in accordance with a first embodiment.
Figure 2:
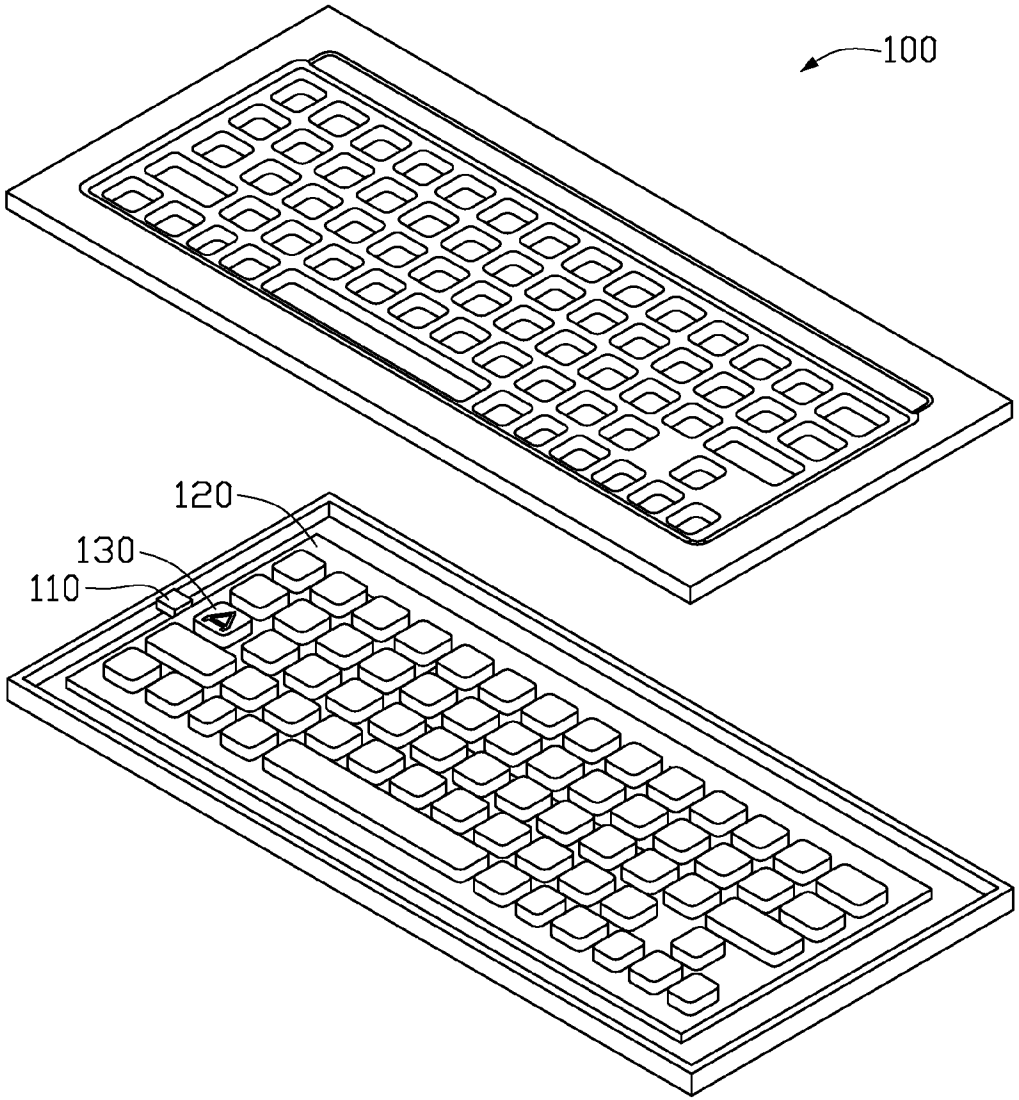
FIG. 2 is a schematic, exploded view of the luminous keyboard assembly of FIG. 1.

Referring to FIGS. 1 and 2, a luminous keyboard assembly 100, in accordance with a first embodiment, includes a light source 110 for emitting light, a light guide plate 120 adjacent to the light source 110 and a plurality of keys 130 mounted on the light guide plate 120. It should be understood that the luminous keyboard assembly 100 may further include a top shell (not labeled), a bottom shell (not labeled) and other components, which are well-known for one skilled in the art.

Figure 3:
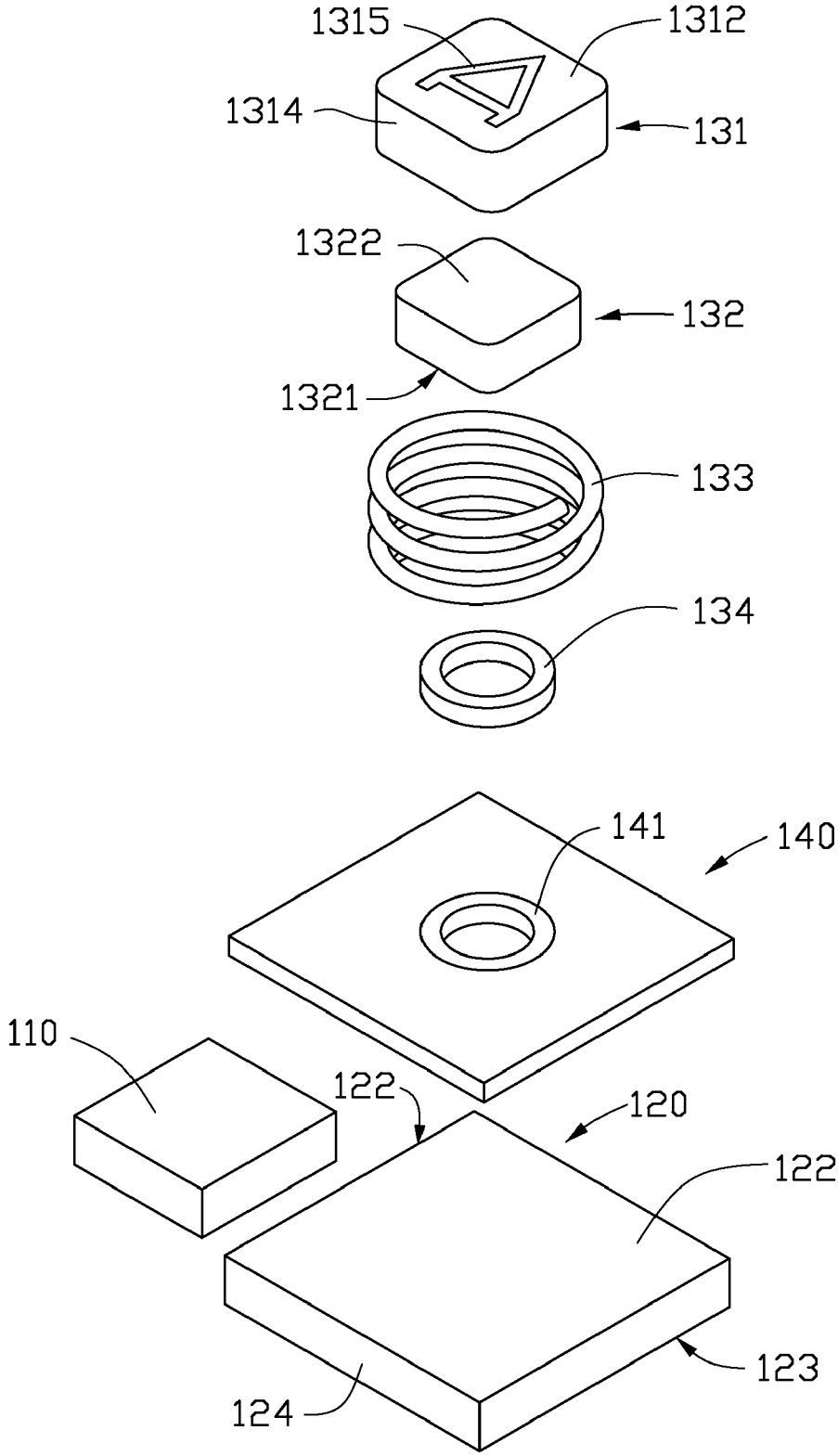
FIG. 3 is a schematic, exploded view of a key of the luminous keyboard assembly of FIG. 2.

Referring to FIG. 3, the light guide plate 120 includes a light incident surface 121 facing the light source 110, a light emitting surface 122 located at a top thereof, a bottom surface 123 opposite to the light emitting surface 122, and several side surfaces 124. The light guide plate 120 receives light beams emitted from the light source 110, and evenly distributes the light beams over the entire light emitting surface 122 of the light guide plate 120 by reflection and diffusion. To improve the uniformity of the light beams from the light emitting surface 122, a plurality of scattering-dots (not shown) are evenly arranged on the bottom surface 123 of the light guide plate 120. The structure of the scattering-dots can be circular, pyramidal, trapeziform or rhombic. To improve the utilization rate of the light beams, a reflecting film (not shown) can be coated on the bottom surface 123 and the side surfaces 124, to let the light beams that arrive to the bottom surface 123 or the side surfaces 124 reflect to the light guide plate 120, and then output from the light emitting surface 122. Also, a reflecting plate (not shown) can be arranged adjacent to the bottom surface 123 and the side surfaces 124. The shape of the light guide plate 120 can be planar or wedge shaped.

The light source 110 can be chosen from a light emitting diode (LED), an incandescence lamp or other kind of colored lamp. In the present embodiment, the light source 110 is a light emitting diode.

The plurality of keys 130 are arranged on the light emitting surface 122 of the light guide plate 120. Each key 130 includes a cap 131, a light guide portion 132 coupled to the cap 131, and a spring member 133 configured for biasing the light guide portion 132 in a direction away from the light emitting surface 122 of the light guide plate 120. Each key 130 is movable relative to the light guide plate 120, in response to manual manipulation thereto, between a depressed position where the light guide portion 132 is attached to and optically coupled to the light emitting surface 122 of the light guide plate 120 thereby illuminating the cap 130, and a rest position where the light guide portion 132 is spaced apart from the light emitting surface 122 of the light guide plate 120.

Figure 4:
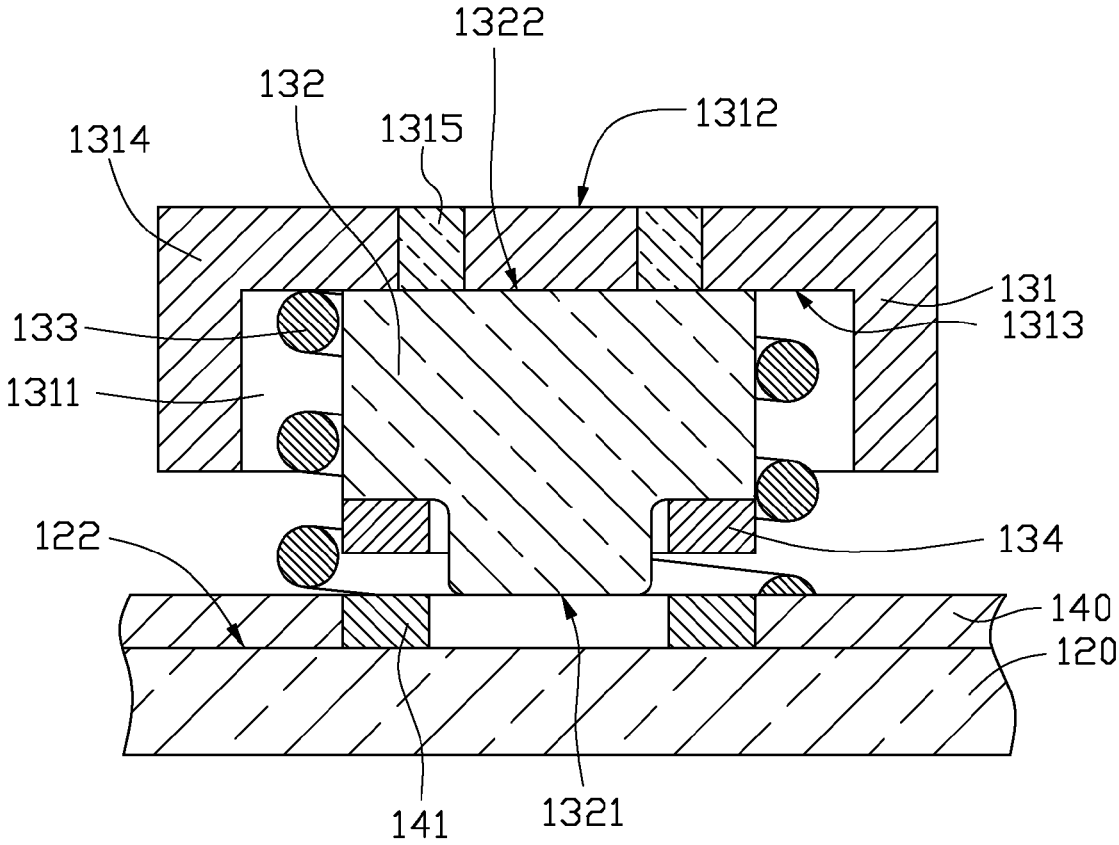
FIG. 4 is a schematic, cross-sectional view of the key in a rest position of the luminous keyboard assembly of FIG. 3.

Referring to FIG. 4, each cap 131 includes a receiving cavity 1311 defined therein. The light guide portion 132 is received in the receiving cavity 1311. Each cap 131 includes an exterior surface 1312 and an interior surface 1313 facing the corresponding light guide portion 132. Each cap 131 further includes an opaque portion 1314 and a light-pervious portion 1315 embedded in the opaque portion 1314. The light-pervious portion 1315 is shaped as an alphanumeric character.

Each light guide portion 132 includes a light incident surface 1321 and a light emitting surface 1322 opposite to the light incident surface 1321. The light incident surface 1321 faces the light emitting surface 122 of the light guide plate 120. The light emitting surface 1322 faces the interior surface 1313 of the cap 131. The light guide portion 132 is made of transparent material and preferably transparent material with elasticity.

To further improve the restoring force of the elastic deformation, the key 130 further includes a spring member 133. The spring member 133 is received in the receiving cavity 1311 of the cap 131. The spring member 133 may be a spring or other common elastomers in this field.

Figure 5:
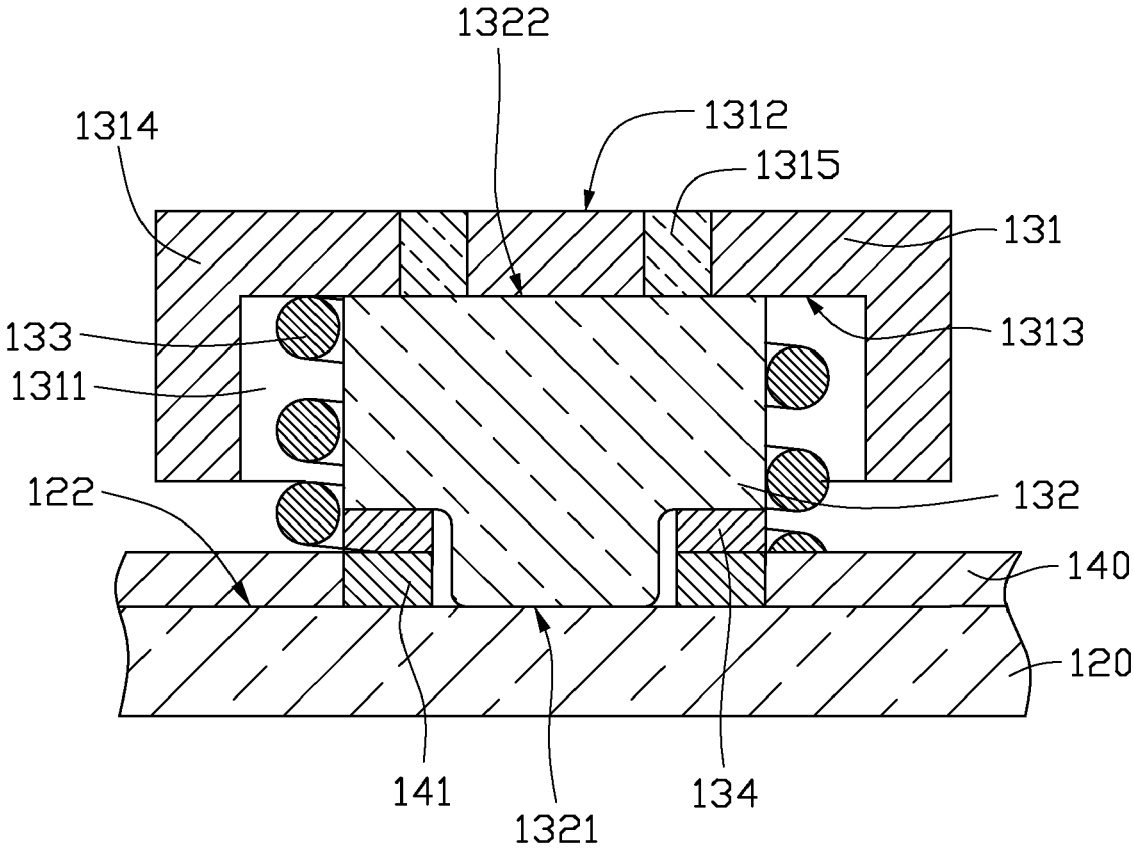
FIG. 5 is a schematic, cross-sectional view of the key in a depressed position of the luminous keyboard assembly of FIG. 4.

Referring to FIGS. 3 and 5, the luminous keyboard assembly 100 further includes a circuit layer 140 with a plurality of contact pads 141. The circuit layer 140 is arranged on the light-emitting surface 122 of the light guide plate 120. Each key 130 includes an electrical contact 134 jointly movable with the light guide portion 132 for coming into contact with the respective contact pads 141 when the key 130 is in the depressed position.

The circuit layer 140 may be made of light-pervious material except the contact pads 141 to enhance the brightness of the light guide portion 132. When the contact pads 141 contact with the electrical contact 134 of the key 130, the circuit layer 140 will send the corresponding information of the key 130 that is pressed to a processor (not shown).

When using the luminous keyboard assembly 100 in a dark condition, the light source 110 is turned on and emits light beams. When the light beams enter the light guide plate 120 from the light incident surface 121, the light source is changed into uniform surface light source and then the light beams emit from the light emitting surface 122 of the light guide plate 120 to provide the backlight for the keys 130. When a key 130 is pressed in response to manual manipulation, the cap 131 is pressed, and the light guide portion 132 moves along with the cap 131 towards the light emitting surface 122 of the light guide plate 120 until the light guide portion 132 contacts with the light guide plate 120. Meantime, the light beams emitted from the light source 110 enter the light incident surface 121 of the light guide plate 120 and output from the light emitting surface 122, then incident into the light guide portion 132 through the light incident surface 1321 of the light guide portion 132, and output from the light emitting surface 1322 of the light guide portion 132. Because the light-pervious portion 1315 of the cap 131 is transparent, the light beams will output from the light-pervious portion 1315 thereby illuminating the cap 131. When the key 130 is released, by the restoring force of the spring member 133, the light guide portion 132 will move apart from the light emitting surface 122 of the light guide plate 120, then the key 130 restores and the brightness of the key 130 back to the same brightness with other keys.

Figure 6:
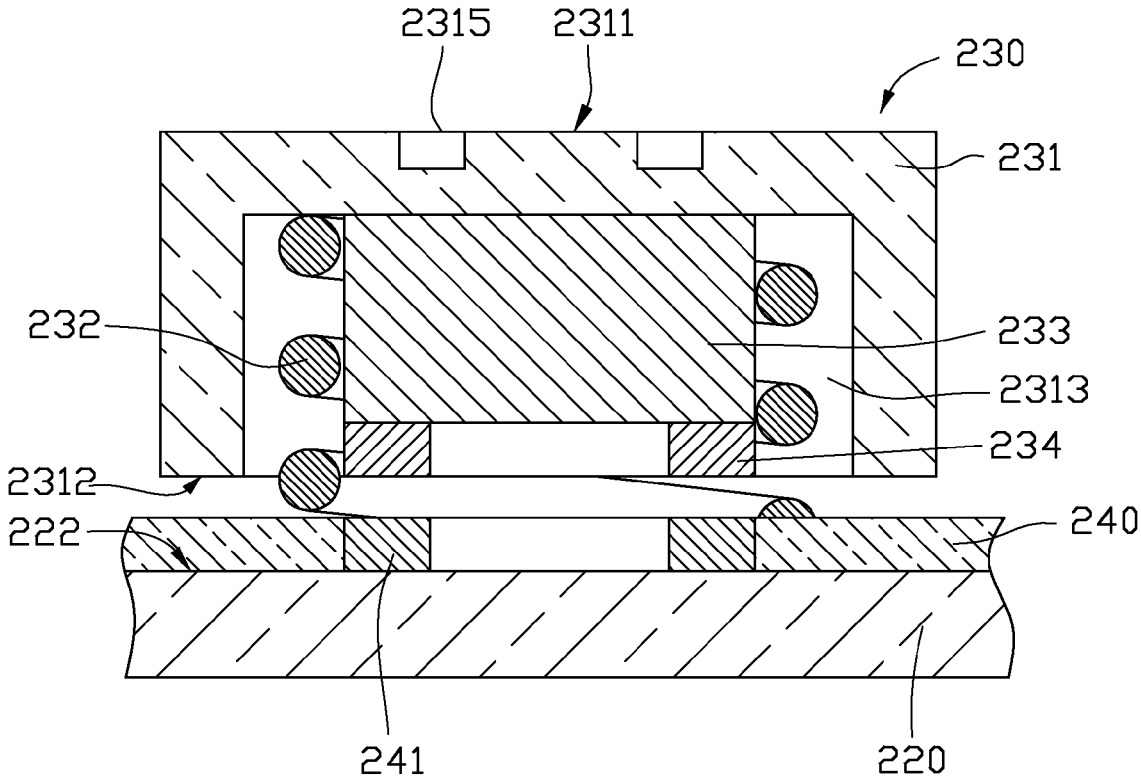
FIG. 6 is a schematic, cross-sectional view of a key in a rest position of a luminous keyboard assembly in accordance with a second embodiment.
Figure 7:
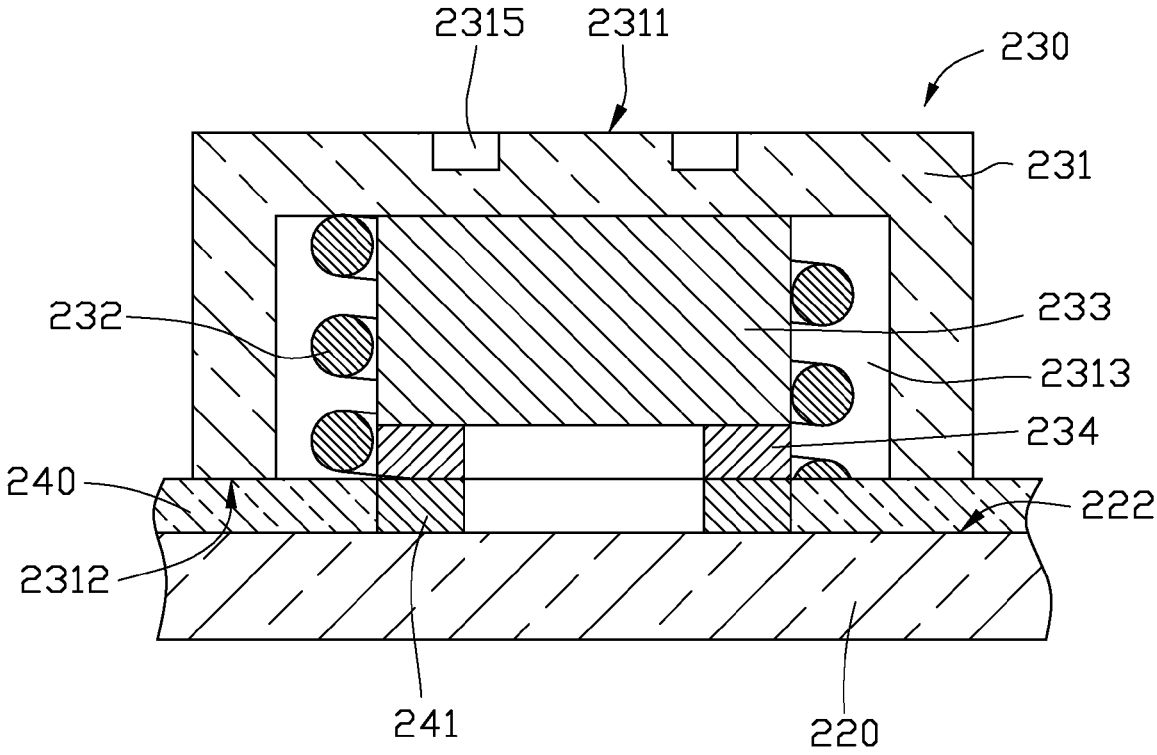
FIG. 7 is a schematic, cross-sectional view of the key in a depressed position of the luminous keyboard assembly of FIG. 6.

Referring to FIGS. 6 and 7, in accordance with a second embodiment of the present invention, a key 230 of a luminous keyboard assembly (not shown) is shown. The difference between the second and the first embodiments is that the structure of the keys 230 and the keys 130 is different. Each key 230 includes a light guiding cap 231 and a spring member 232 configured for biasing the light guiding cap 231 in a direction away from the light emitting surface 222 of the light guide plate 220.

The light guiding cap 231 has the similar structure with the cap 131 of the key 130 of the first embodiment. The light guiding cap 231 includes atop surface 2311 with an alphanumeric symbol 2315 thereon and a bottom surface 2312 facing to the light emitting surface 222 of the light guide plate 220. Each key 230 is movable relative to the light guide plate 220, in response to manual manipulation thereto, between a depressed position where the bottom surface 2312 of the light guiding cap 231 is attached to and optically coupled to the light emitting surface 222 of the light guide plate 220 thereby the light guiding cap 231 is illuminated, and a rest position where the bottom surface 2312 of the light guiding cap 231 is spaced apart from the light emitting surface 222 of the light guide plate 220.

The light guiding cap 231 is comprised of a light pervious material. To prevent the light beams output from other surfaces of the light guiding cap 231 and make the light beams only output from the area of alphanumeric symbol 2315, an opaque material may be coated on other surfaces of the light guiding cap 231 except the area of alphanumeric symbol 2315 and the bottom surface 2312.

Each key 230 may further includes a supporting member 233 configured for fixing the spring member 232. The light guiding cap 231 further includes a receiving cavity 2313 configured for receiving the supporting member 233 and the spring member 232. The luminous keyboard assembly (not shown) of the second embodiment further includes a circuit layer 240 arranged between the keys 230 and the light guide plate 220. Similar with the structure of the circuit layer 140 of the first embodiment, the circuit layer 240 includes a plurality of contact pads 241. Each key 230 includes an electrical contact 234 jointly movable with the supporting member 233 for coming into contact with the respective contact pad 241 when the key 230 is in the depressed position.

The circuit layer 240 is made of light-pervious material except the contact pads 241 to enhance the brightness of the light guiding cap 231.

When using the luminous keyboard assembly of the second embodiment, if a key 230 is pressed in response to manual manipulation, the light guiding cap 131 is pressed, and moves towards the light emitting surface 222 of the light guide plate 220 until the bottom surface 2312 of the light guiding cap 231 is attached to and optically coupled to the light emitting surface 222 of the light guide plate 220. Because the light guiding cap 231 is comprised of a light pervious material, the light beams will illuminate the key 230. When the key 230 is released, by the restoring force of the spring member 233, the light guiding cap 231 will move apart from the light emitting surface 222 of the light guide plate 220, then the key 230 restores and the brightness of the key 230 back to the same brightness with other keys.

Figure 8:
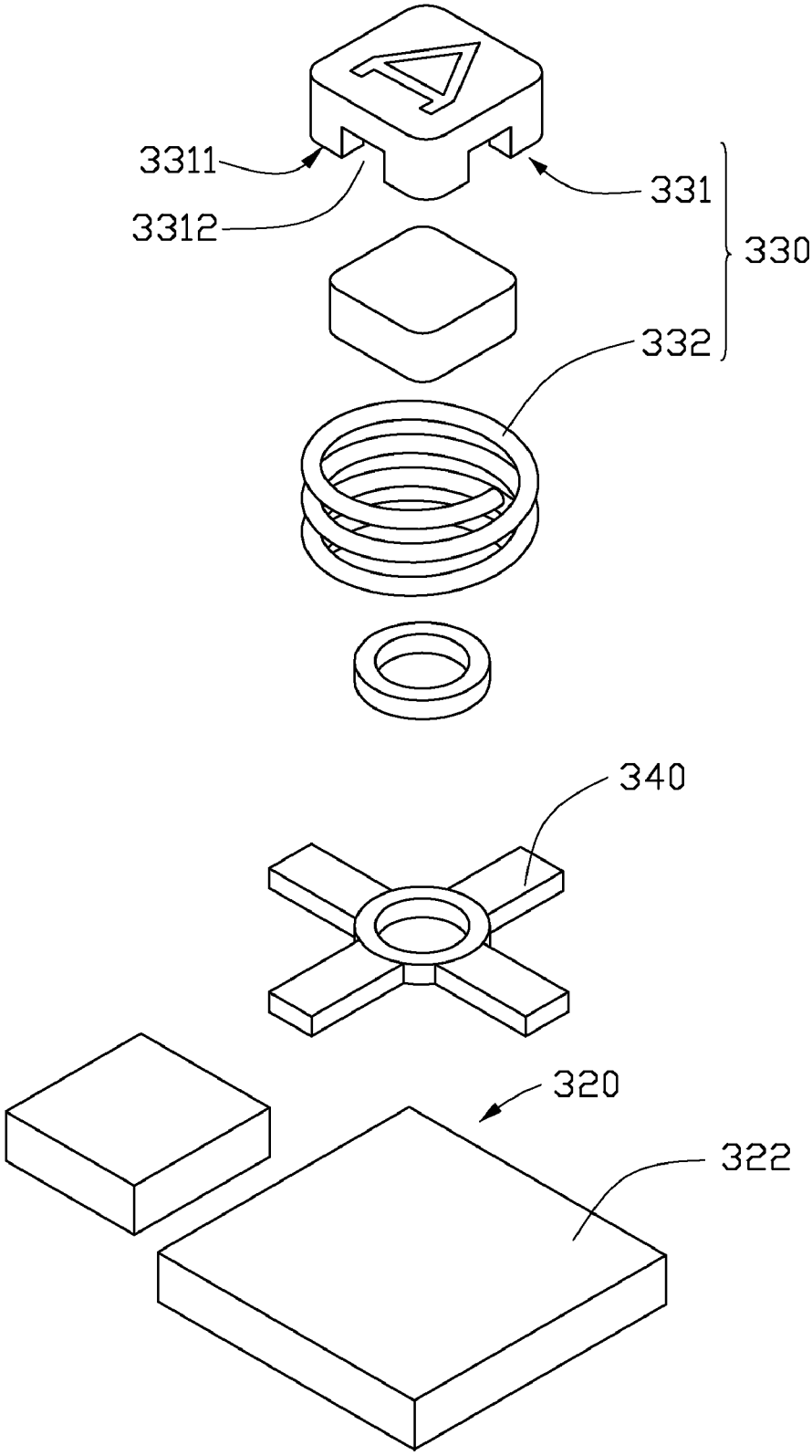
FIG. 8 is a schematic, exploded view of a key of a luminous keyboard assembly in accordance with a third embodiment.
Figure 9:
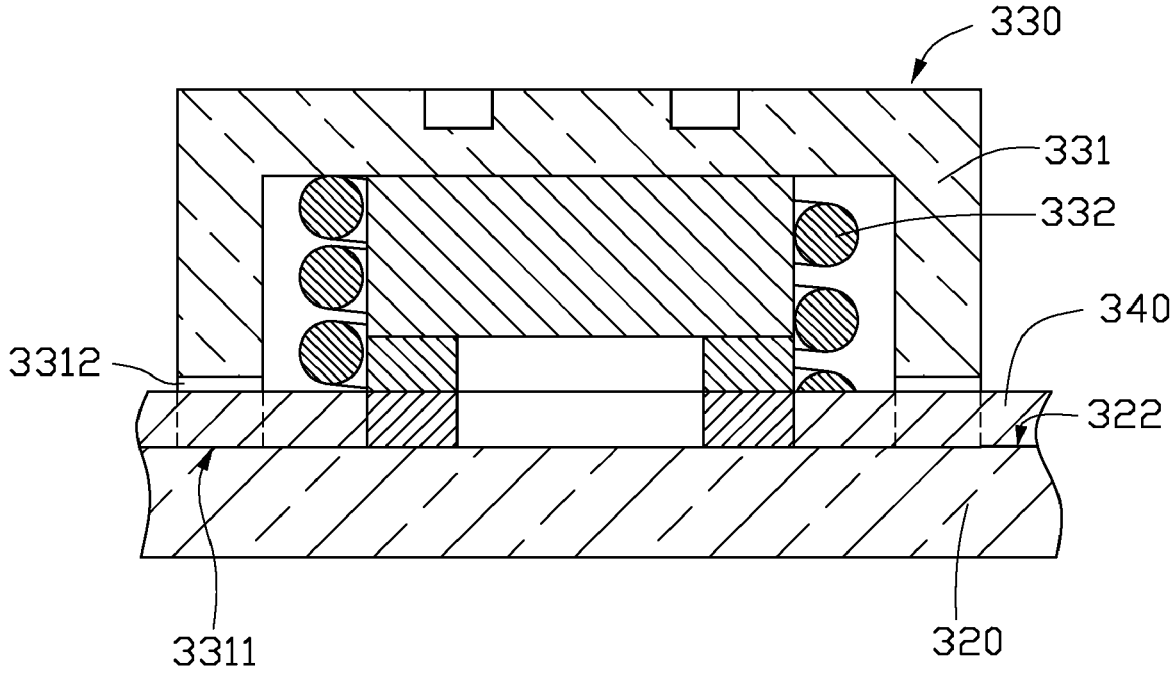
FIG. 9 is a schematic, cross-sectional view of the key in a depressed position of the luminous keyboard assembly of FIG. 8.

Referring to FIGS. 8 and 9, in accordance with a third embodiment of the present invention, a key 330 of a luminous keyboard assembly (not shown) is shown. The difference between the third and the second embodiments is that the structure of the keys 330 and the keys 230 is different.

In the present embodiment, each key 330 includes a light guiding cap 331 and a spring member 332. The light guiding cap 331 has the similar structure with the light guiding cap 231 of the key 230 of the second embodiment, except that the light guiding cap 331 of each key 330 defines a cutout 3312 in the bottom surface 3311 for receiving a portion of the circuit layer 340.

When a key 330 is pressed, referring to FIG. 9, a portion of the circuit layer 340 is received in the light guiding cap 331. The bottom surface 3311 directly contacts the light emitting surface 322 of the light guide plate 320 without the obstruction of the circuit layer 340. Therefore, comparing with the second embodiment, the key 330 may have better luminescence efficiency than that of the key 230.

While the present invention has been described as having preferred or exemplary embodiments, the embodiments can be further modified within the spirit and scope of this disclosure. This application is therefore intended to cover any variations, uses, or adaptations of the embodiments using the general principles of the invention as claimed. Further, this application is intended to cover such departures from the present disclosure as come within known or customary practice in the art to which the invention pertains and which fall within the limits of the appended claims or equivalents thereof.

What is claimed is:

1. A keyboard assembly comprising:

a light source for emitting light;

a light guide plate including a light incident surface facing the light source and a light emitting surface; and a plurality of keys mounted on the light guide plate, each key comprising a cap, a light guide portion coupled to the cap, and a spring member configured for biasing the light guide portion in a direction away from the light emitting surface of the light guide plate, each key being movable relative to the light guide plate, in response to manual manipulation thereto, between a depressed position where the light guide portion is attached to and optically coupled to the light emitting surface of the light guide plate thereby illuminating the cap, and a rest position where the light guide portion is spaced apart from the light emitting surface of the light guide plate; wherein each cap comprises a receiving cavity defined therein, the light guide portion being received in the receiving cavity.

2. The keyboard assembly of claim 1, wherein each cap comprises an exterior surface and an interior surface facing the corresponding light guide portion, and each cap includes an opaque portion and a light-pervious portion embedded in the opaque portion, the light-pervious portion being shaped as an alphanumeric character.

3. The keyboard assembly of claim 2, wherein each light guide portion comprises a light incident surface and a light-emitting surface opposite to the light incident surface, the light incident surface facing the light-emitting surface of the light guide plate, the light-emitting surface facing the interior surface of the cap.

4. The keyboard assembly of claim 1, further comprising a circuit layer with a plurality of contact pads, wherein each key comprises an electrical contact jointly movable with the light guide portion for coming into contact with the respective contact pad when the key is in the depressed position.

5. The keyboard assembly of claim 4, wherein the circuit layer is arranged on the light-emitting surface of the light guide plate.

6. The keyboard assembly of claim 4, wherein the circuit layer is arranged between the keys and the light guide plate.

7. A keyboard assembly comprising:

a light source for emitting light;

a light guide plate including a light incident surface facing the light source and a light emitting surface; and a plurality of keys mounted on the light guide plate, each key comprising a light guiding cap and a spring member configured for biasing the light guiding cap in a direction away from the light emitting surface of the light guide plate, the light guiding cap having a top surface for forming an alphanumeric symbol thereon and a bottom surface, each key being movable relative to the light guide plate, in response to manual manipulation thereto, between a depressed position where the bottom surface of the light guiding cap is attached to and optically coupled to the light emitting surface of the light guide plate thereby the light guiding cap being illuminated, and a rest position where the bottom surface of the light guiding cap is spaced apart from the light emitting surface of the light guide plate; wherein each cap comprises a receiving cavity defined therein, a light guide portion being received in the receiving cavity.

8. The keyboard assembly of claim 7, wherein each light guiding cap is comprised of a light pervious material.

9. The keyboard assembly of claim 7, further comprising a circuit layer arranged between the keys and the light guide plate, wherein the light guiding cap of each key defines a cutout in the bottom surface for receiving a portion of the circuit layer.

10. The keyboard assembly of claim 7, wherein each light guiding cap comprises a receiving cavity defined therein, the spring member being received in the receiving cavity.

* * * * *